United States Patent [19]

Sasaki

[11] Patent Number: 4,800,694

[45] Date of Patent: Jan. 31, 1989

[54] PLACE-ON TYPE ASSEMBLAGE STRUCTURE

[75] Inventor: Mitsuo Sasaki, Yamato, Japan

[73] Assignee: Tsugarusoken Co., Ltd., Yamato, Japan

[21] Appl. No.: 33,561

[22] Filed: Apr. 3, 1987

[30] Foreign Application Priority Data

Apr. 17, 1986 [JP] Japan ..... 61-87089

[51] Int. Cl.[4] ..... E04H 6/10; E04H 6/42

[52] U.S. Cl. ..... 52/175; 52/645; 52/646; 52/648; 108/53.1; 108/52.1; 108/51.1

[58] Field of Search ..... 52/175, 301, 263, 252, 52/283, 645, 646, 648, 721, 167, 280; 108/51.1, 53.1, 52.1

[56] References Cited

U.S. PATENT DOCUMENTS

| | | | |
|---|---|---|---|
| 225,060 | 3/1980 | Johnson | 52/283 |
| 1,189,492 | 7/1916 | Schanman | 52/280 |
| 1,258,409 | 3/1918 | Hill | 52/648 |
| 1,808,741 | 6/1931 | Alt | 52/175 |
| 3,808,757 | 5/1974 | Greenwood | 52/184 |
| 3,831,329 | 8/1974 | Lear | 52/296 |
| 3,831,774 | 8/1974 | Moore | 248/357 |
| 3,914,063 | 10/1975 | Papayoti | 52/648 |
| 3,971,179 | 7/1976 | Bodocsi et al. | 52/223 R |
| 4,323,016 | 4/1982 | Flesher et al. | 108/51.1 |
| 4,442,989 | 4/1984 | Hartmann | 52/167 |

FOREIGN PATENT DOCUMENTS

| | | |
|---|---|---|
| 1009849 | 11/1965 | United Kingdom . |
| 1073306 | 6/1967 | United Kingdom . |
| 1298679 | 12/1972 | United Kingdom . |
| 1310023 | 3/1973 | United Kingdom . |
| 1476329 | 6/1977 | United Kingdom . |
| 1494085 | 12/1977 | United Kingdom . |
| 2054694A | 2/1981 | United Kingdom . |
| 1604195 | 12/1981 | United Kingdom . |
| 2164674A | 3/1986 | United Kingdom . |

*Primary Examiner*—James L. Ridgill, Jr.

*Attorney, Agent, or Firm*—Beveridge, DeGrandi & Weilacher

[57] ABSTRACT

A place-on type assemblable structure comprising an assembly element having a base plate to be placed on a substantially flat surface and a pillar extending upwardly from the base plate, in which a vertical load acting on the pillar is borne substantially by the base plate. This structure needs not to be fixed to the flat surface, and therefore can be assembled and disassembled in the field and reutilized without scrapping.

13 Claims, 6 Drawing Sheets

PLACE-ON TYPE ASSEMBLAGE STRUCTURE

FIELD OF THE INVENTION

This invention relates to a place-on type structure which can be assembled and disassembled.

DESCRIPTION OF THE PRIOR ART

Generally, structures such as a parking place providing three-dimensional parking spaces are permanently set up on the land. Building such a permanent structure, however, is costly and time-consuming. Furthermore, when it is desired to use the land for another purpose, the structure built on it should be broken down. This is a waste of the structure and requires the cost of scrapping.

SUMMARY OF THE INVENTION

It is a primary object of this invention to provide a novel and excellent place-on type structure which can be assembled and disassembled and reutilized without scrapping.

Another object of this invention is to provide a novel and excellent place-on type structure which is easy to assemble and disassemble within a shortened period of time.

According to this invention, there is provided a place-on type structure adapted to be placed on a substantially flat surface, said structure including an assembly element having a base plate to be placed on said surface and a pillar extending upwardly from the base plate wherein a vertical load acting on the pillar is substantially borne by the base plate.

DETAILED DESCRIPTION OF THE PREFERRED EMBODIMENTS

One specific embodiment of the place-on type assemblable structure constructed in accordance with this invention will be described with reference to the accompanying drawings.

Figure 1:
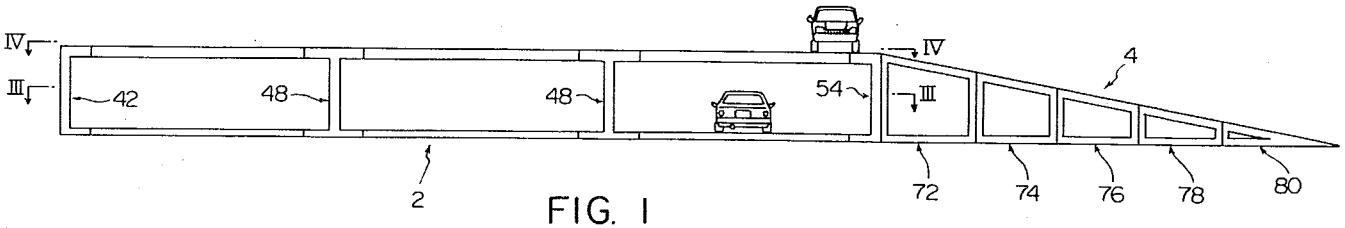
FIG. 1 is a front elevation showing one specific embodiment of the place-on type assemblable structure of the invention.
Figure 2:
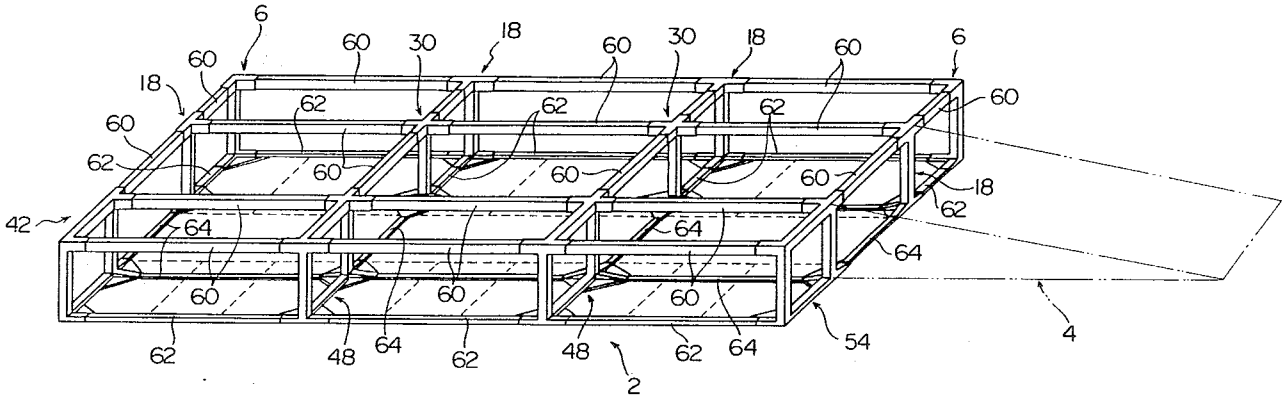
FIG. 2 is a perspective view of the main body of the assemblable structure of FIG. 1.

With reference to FIGS. 1 and 2, the illustrated place-on type assemblable structure has a main body shown generally at 2. The main body 2 can be conveniently utilized as a parking station for providing three-dimensional vehicle parking spaces as will be described hereinafter, and in relation to this utility, an inclined passage assembly 4 is annexed to it.

Figure 3:
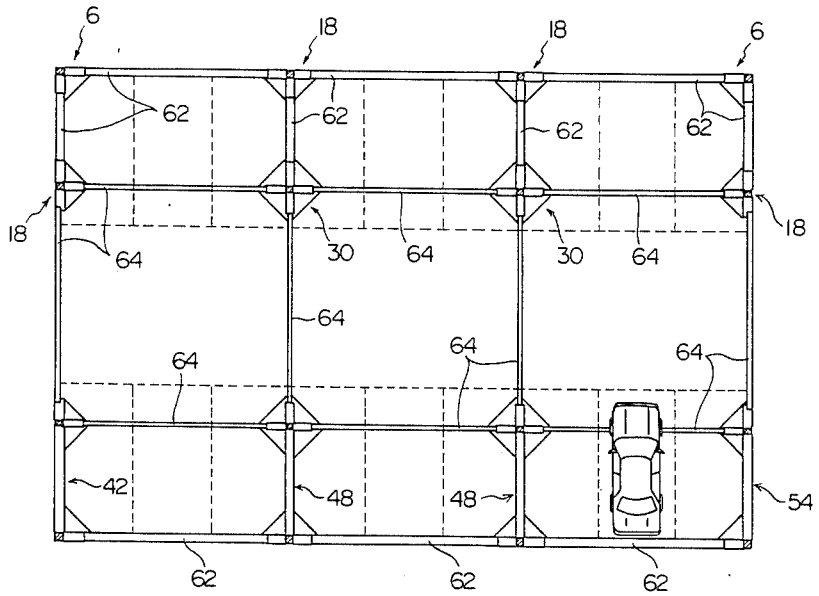
FIG. 3 is a sectional view taken along line III—III of FIG. 1.
Figure 4:
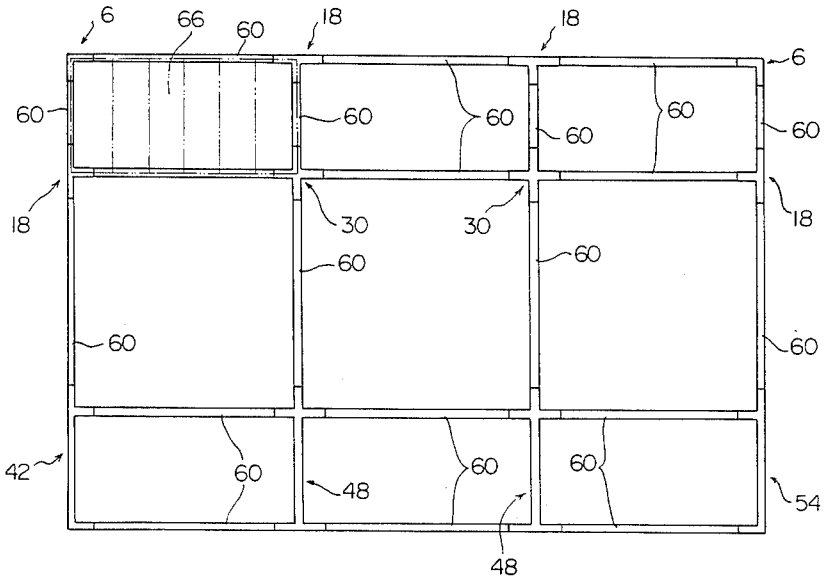
FIG. 4 is a top plan view taken along line IV—IV in FIG. 1.
Figure 7:
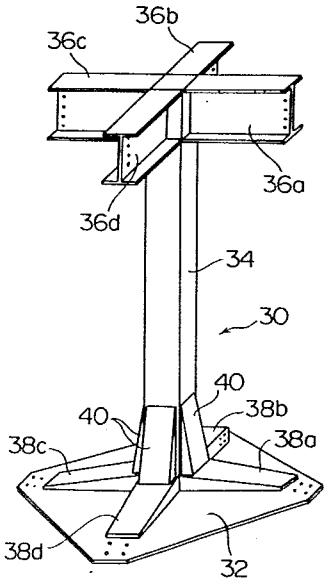
FIG. 7 is a perspective view showing a third embodiment of the assembly element in the assemblable structure shown in FIG. 1.
Figure 6:
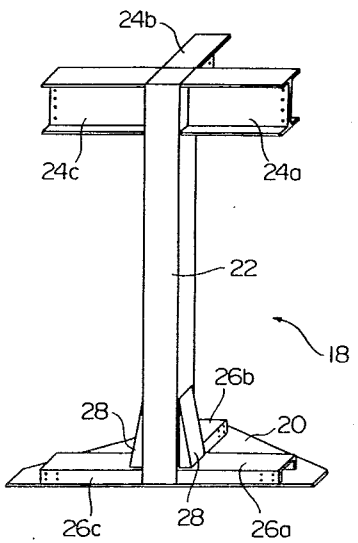
FIG. 6 is a perspective view showing a second embodiment of the assembly element in the assemblable structure shown in FIG. 1.
Figure 5:
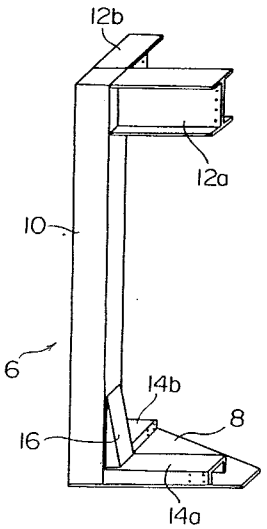
FIG. 5 is a perspective view showing a first embodiment of the assembly element in the assemblable structure shown in FIG. 1.

With reference to FIGS. 3 and 4 also, the illustrated main body 2 of the structure is assembled in the form shown in FIGS. 1 to 4 by assembling several kinds of assembly elements, but is basically comprised of three types of assembly elements shown in FIGS. 5 to 7.

As will be seen from FIGS. 2 to 4, an assembly element 6 of the first embodiment shown in FIG. 5 is used at the corner portions of the main body 2. The assembly element 6 has a substantially flat base plate 8 and a pillar 10 extending upwardly from the base plate 8. The base plate 8 can be made of, for example, a steel sheet having the shape of a nearly right-angled equilateral triangle. The pillar 10 may be formed, for example, of a hollow steel post having a substantially rectangular cross-sectional shape. In the illustrated embodiment, the lower end of the pillar 10 is fixed by welding or otherwise to a specific right-angled corner part of the base plate 8, and the other corner parts of the base plate 8 are chamfered in a straight line. The pillar 10 extends upwardly in a substantially vertical fashion from the upper surface of the base plate 8 and two connecting portions **12*a* and 12*b* are provided at the upper end portion of the pillar 10. In the illustrated embodiment, the connecting portions 12*a* and 12*b* are fixed to the side surface of the pillar 10 by welding or otherwise, and each made up of a steel material having an H-shaped section. They extend in a lateral direction which is substantially perpendicular to the axial direction of the pillar 10, and are spaced from each other substantially by an angle of 90 degrees. One connecting portion 12*a* extends laterally from one side surface of the pillar 10 and substantially parallel to one edge portion defining the aforesaid specific corner part of the base plate 8, and the other connecting portion 12*b* extends laterally from that side surface of the pillar 10** which is adjacent to the aforesaid one side surface, and substantially parallel to the other edge portion defining the specific corner part of the base plate.

Preferably, reinforcing materials **14*a* and 14*b* and corresponding reinforcing materials 16 are provided in the assembly element 6 as shown in FIG. 5. The reinforcing materials 14*a* and 14*b* may be formed of a steel material having a channel-shaped section. One reinforcing element 14*a* is disposed along the aforesaid one edge portion of the base plate 8 with its one end fixed to the pillar 10 and its open lower end fixed to the upper surface of the base plate 8. The other reinforcing material 14*b* is disposed along the aforesaid other edge portion of the base plate 8 with its one end fixed to the pillar 10 and its open lower end fixed to the upper surface of the base plate 8. The reinforcing materials 16 are disposed correspondingly to the reinforcing materials 14***a* and 14*b* (only one reinforcing material 16 is shown in FIG. 5). The reinforcing materials 16 are formed of a nearly wedge-shaped steel material. One reinforcing material 16 is disposed with its one side surface fixed to the pillar 10 (more specifically, to the lower end portion of that side surface of the pillar 10 at which the connecting portion 12*a* is provided). The other reinforcing material 16 (not shown) is disposed with its pointed one end facing upwards, its other end fixed to the upper surface of the reinforcing material 14*b* and its one side surface fixed to the pillar 10 (more specifically, to the lower end portion of the side surface of the pillar 10 at which the connecting portion 12*b* is provided). These reinforcing materials 14*a*, 14*b* and 16 may also be fixed by welding or otherwise.

An assembly element 18 in accordance with the second embodiment shown in FIG. 6 is used at the outside portion of the main body 2 of the structure excepting the aforesaid corner parts, as can be seen from FIGS. 2 to 4. The assembly element 18 has a substantially flat base plate 20 and a pillar 22 extending upwardly from the base plate 20. The illustrated base plate 20 is formed of a steel sheet in the shape of a nearly right-angled equilateral triangle (the area of the base plate 20 is nearly twice that of the base plate 8 of the assembly element 6 in the first embodiment). The pillar 22 is formed of a hollow steel post having a substantially rectangular cross-sectional shape. In the illustrated embodiment, the lower end of the pillar 22 is fixed to the central part of that edge portion of the base plate 20 which is opposite to a specific right-angled corner part thereof, and the three corner parts of the base plate 20 are chamfered in a straight line. The pillar 22 extends upwardly in a substantially vertical fashion from the upper surface of the base plate 20, and three connecting portions 24*a*, 24*b* and 24*c* are provided at its upper end portion. In the illustrated embodiment, the three connecting portions 24*a*, 24*b* and 24*c* are fixed respectively to the side surface of the pillar 22 and are made of a steel material having an H-shaped cross section. These connecting portions extend in a lateral direction substantially perpendicular to the axial direction of the pillar 22 and spaced from each other by an angle of 90 degrees. Specifically, the connecting portion 24*a* extends laterally from one side surface of the pillar 22 and substantially parallel to that edge portion of the base plate 20 which is opposite to the aforesaid specific corner part. The connecting portion 24*b* extends laterally from that side surface of the pillar 22 which is adjacent to the aforesaid one side surface, and substantially parallel to a direction substantially perpendicular to the edge portion of the base plate 20 opposite to the specific corner part. The connecting portion 24*c* extends laterally (therefore, in a direction substantially opposite to the connecting portion 24*a*) from that side surface of the pillar 22 which is opposite to the aforesaid one side surface, and substantially parallel to the edge portion of the base plate 20 opposite to the specific corner part.

Preferably, reinforcing materials 26*a*, 26*b* and 26*c* and corresponding reinforcing materials 28 are provided in the assembly element 18 as shown in FIG. 6. The reinforcing materials 26*a*, 26*b* and 26*c* correspond to the reinforcing materials 14*a* and 14*b* in the assembly element 6 in accordance with the first embodiment, and may be formed of a steel material having a channel-shaped cross section. The reinforcing material 26*a* is disposed along that edge portion of the base plate 20 which is opposite to the specific corner part with its one end fixed to the pillar 22 and its open lower end fixed to the upper surface of the base plate 20. The reinforcing material 26*b* is disposed in the central part of the base plate 20 in a direction substantially perpendicular to the edge portion of the base plate 20 opposite to the specific corner part. One end of the reinforcing material 26*b* is fixed to the pillar 22, and its open lower end is fixed to the upper surface of the base plate 20. The reinforcing material 26*c* is disposed opposite to the reinforcing material 26*a* along the edge portion of the base plate 20 opposite to the specific corner part with its one end fixed to the pillar 22 and its open lower end fixed to the upper surface of the base plate 20. On the other hand, the reinforcing materials 28 correspond to the reinforcing materials 16 in the assembly element 6 in the first embodiment. They are formed of a nearly wedge-shaped steel material and are disposed correspondingly to the reinforcing materials 26*a*, 26*b* and 26*c* (in FIG. 6, two reinforcing materials 28 are shown), and fixed in the same way as in the case of the reinforcing materials 16. Specifically, the reinforcing material 28 corresponding to the reinforcing material 26*a* is disposed with its lower end fixed to the upper surface of the reinforcing material 26*a* and its one side surface fixed to the pillar 22 (more specifically, to the lower end portion of that side surface of the pillar 22 on which the connecting portion 24*a* is provided). The reinforcing material 28 (not shown) corresponding to the reinforcing material 26*b* is disposed with its lower end fixed to the upper surface of the reinforcing material 26*b* and its one side surface fixed to the pillar 22 (more specifically, to the lower end portion of that side surface of the pillar 22 on which the connecting portion 24*b* is provided). The reinforcing material 28 corresponding to the reinforcing material 26*c* is disposed with its lower end fixed to the upper surface of the reinforcing material 26*c* and its one side surface fixed to the pillar 22 (more specifically, to the lower end portion of that side surface of the pillar 22 on which the connecting portion 24*c* is provided). The various members in the assembly element 18 in the second embodiment may be fixed by welding or otherwise.

An assembly element 30 in the third embodiment shown in FIG. 7 is used in the interior portion of the main body 2 of the structure, as can be understood from FIGS. 2 to 4. The assembly element 30 has a substantially flat base plate 32 and a pillar 34 extending upwardly from the base plate 32. The illustrated base plate 32 is formed of a nearly square steel sheet (the area of the base plate 32 is nearly four times that of the base plate 8 in the assembly element 6 in the first embodiment), and the pillar 34 is formed of a hollow steel post having a substantially rectangular cross-sectional shape. In the illustrated embodiment, the lower end of the pillar 34 is fixed to the substantially central portion of the base plate 32, and the four corner parts of the base plate 32 are chamfered in a straight line. The pillar 34 extends upwardly in a substantially vertical fashion from the upper surface of the base plate 32, and four connecting portions 36*a*, 36*b*, 36*c* and 36*d* are provided at the upper end portion of the pillar 34. In the illustrated embodiments, the four connecting portions 36*a*, 36*b*, 36*c* and 36*d* are fixed to the side surfaces of the pillar 34, and are formed of a steel material having an H-shaped cross section. The four connecting portions extend in a lateral direction which is substantially perpendicular to the axial direction of the pillar 34, and are spaced from each other by an angle of 90 degrees. Specifically, the connecting portion 36*a* extends laterally from one side surface of the pillar 34 and substantially parallel to one diagonal line of the base plate 32. The connecting portion 36*b* extends laterally from one side surface of the pillar 34 which is adjacent to the aforesaid one side surface, and substantially parallel to the other diagonal line of the base plate 32. The connecting portion 36*c* extends laterally (therefore, in a direction substantially opposite to the connecting portion 36*a*) from that side surface of the pillar 34 which is opposite to the aforesaid one side surface, and substantially parallel to the aforesaid one diagonal line of the base plate 32. The connecting portion 36*d* extends laterally (therefore, in a direction substantially opposite to the connecting portion 36*b*) from the other side surface of the pillar 34 adjacent to the aforesaid one side surface and substantially parallel to the aforesaid other diagonal line of the base plate 32.

Preferably, reinforcing materials 38*a*, 38*b*, 38*c* and 38*d* and corresponding reinforcing materials 40 are provided in the assembly element 30 as shown in FIG. 7. The reinforcing materials 38*a* to 38*d* correspond to the reinforcing materials 14*a* and 14*d* in the assembly element 6 in the first embodiment. The reinforcing materials 38*a*, 38*c* and 38*d* are each formed of a nearly wedge-shaped steel material, and the reinforcing material 38*b*, of a steel material having a channel-shaped cross section. The reinforcing material 38*a* is disposed along the aforesaid one diagonal line of the base plate 32 with its one end fixed to the pillar 34 and its lower end fixed to the upper surface of the base plate 32. The reinforcing material 38*b* is disposed along the other diagonal line of the base plate 32 with its one end fixed to the pillar 34 and its open lower end fixed to the upper surface of the base plate 32. The reinforcing material 38*c* is disposed opposite to the reinforcing material 38*a* along the aforesaid one diagonal line of the base plate 32 with its one end fixed to the pillar 34 and its lower end fixed to the upper surface of the base plate 32. The reinforcing material 38*d* is disposed opposite to the reinforcing material 38*b* along the aforesaid other diagonal line of the base plate 32 with its one end fixed to the pillar 34 and its lower end fixed to the upper surface of the base plate 32. The reinforcing materials 40 correspond to the reinforcing materials 16 in the assembly element 6 in the first embodiment. They are formed of a nearly wedge-shaped steel material and disposed correspondingly to the reinforcing materials 38*a* to 38*d* (three reinforcing materials 40 are shown in FIG. 7). The reinforcing materials 40 are fixed in the same way as in the case of the reinforcing materials 16. Specifically, the reinforcing material 40 corresponding to the reinforcing material 38*a* is fixed at its lower end to the upper surface of the reinforcing material 38*a* and at its one side surface to the pillar 34 (more specifically, to the lower end portion of that side surface of the pillar 34 on which the connecting portion 36*a* is provided). The reinforcing material 40 (not shown) corresponding to the reinforcing material 38*b* is fixed at its lower end to the upper surface of the reinforcing material 38*b* and at its one side surface to the pillar 34 (more specifically, to the lower end portion of that side surface of the pillar 34 on which the connecting portion 36*b* is provided). The reinforcing material 40 corresponding to the reinforcing material 38*c* is fixed at its lower end to the upper surface of the reinforcing material 38*c* and at its one side surface to the pillar 34 (more specifically, to the lower end portion of that side surface of the pillar 34 on which the connecting portion 36*c* is provided). The reinforcing material 40 corresponding to the reinforcing material 38*d* is fixed at its lower end to the upper surface of the reinforcing material 38*d* and at its one side surface to the pillar 34 (more specifically, to the lower end portion of that side surface of the pillar 34 on which the connecting portion 36*d* is provided). The various members in the assembly element 30 in the third embodiment can also be fixed by welding or otherwise.

The reinforcing materials 14*a* and 14*b*, 26*a* to 26*c* and 38*a* to 38*d* in the assembly elements 6, 18 and 30 mainly act against vertical loads (loads in the axial direction of the pillars) acting on the pillars 10, 22 and 34. The reinforcing materials 16, 28 and 40 act mainly against lateral loads (loads acting in a direction perpendicular to the axial direction of the pillar) acting on the pillars 10, 22 and 34. Hence, when the strength of the assembly element is sufficient with regard to vertical loads, the reinforcing materials 14*a* and 14*b*, 26*a* to 26*c* and 38*a* to 38*d* may be partly or wholly omitted. Furthermore, when the assembly element has sufficient strength against lateral loads, the reinforcing materials 16, 28 and 40 may be partly or wholly omitted.

The base plates 8, 20 and 32 in the assembly elements 6, 18 and 30 should not necessarily be of the aforesaid shapes, and may be of any other suitable shape which can sufficiently support vertical loads acting on the pillars 10, 22 and 34. However, when the assembly elements (particularly the assembly elements 8 and 18) are of the aforesaid shapes, the base plates 8 and 20 do not partly project outwardly of the main body 2 of the structure, and the land can be effectively utilized and safety can be secured, as can be understood from FIGS. 2 to 4.

As will be understood from the following description, the place-on type assemblable structure in accordance with this invention is constructed basically of the assembly elements 6, 18 and 30 in the first to third embodiments shown in FIGS. 5 to 7. In addition to, or in place of, these assembly elements resulting from suitable combinations of the assembly elements 6, 18 and 30 in the first to third embodiments may also be used.

Now, with reference to FIGS. 8 to 10, modified embodiments of the assembly elements will be described. For easy understanding, in FIGS. 8 to 10, substantially the same members as those shown in FIGS. 5 to 7 are designated by the same reference numerals as in FIGS. 5 to 7.

Figure 8:
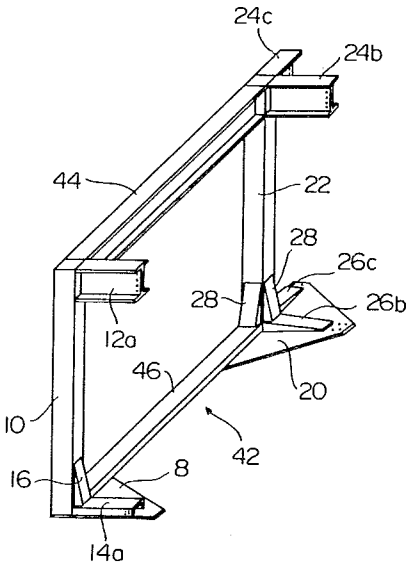
FIG. 8 is a perspective view showing a fourth embodiment of the assembly element in the assemblable structure shown in FIG. 1.

With reference to FIG. 8, an assembly element 42 in the fourth embodiment is constructed by combining the assembly element 6 in the first embodiment shown in FIG. 5 and the assembly element 18 in the second embodiment shown in FIG. 6. As will be described later, the upper portions of the assembly elements 6 and 18 are connected to each other detachably via a beam member their lower end portions are connected detachably via a brace member. In the assembly element 42 in the fourth embodiment, these connecting members are fixed between the two assembly elements to form an integral unit. Specifically, the assembly element 42 has a base plate 8, a pillar 10 extending upwardly from the base plate 8, a base plate 20, and a pillar 22 extending upwardly from the base plate 20. One end of a beam member 44 is fixed to the upper end portion of the pillar 10 and the other end of the beam member 44, to the upper end portion of the pillar 22. Furthermore, one end of a brace member 46 is fixed to the lower end portion of the pillar 10, and the other end of the brace member 46, to the lower end portion of the pillar 22. Correspondingly to the brace member 46, reinforcing materials 16 and 28 (only one of the two reinforcing members 16 and two of the three reinforcing members 28 are shown in FIG. 8) are disposed in the same way as in the case of reinforcing materials 14*a*, 26*b* and 26*c*. In other words, as can be easily understood from a comparison of FIGS. 5 and 6 with FIG. 8, the assembly element 42 in the fourth embodiment is constructed by connecting the assembly element 6 shown in FIG. 5 and the assembly element 18 shown in FIG. 6 via the beam member 44 instead of providing the connecting portions 12*b* and 24*a* and also via the brace member 46 instead of providing the reinforcing members 14*b* and 26*a*.

Figure 9:
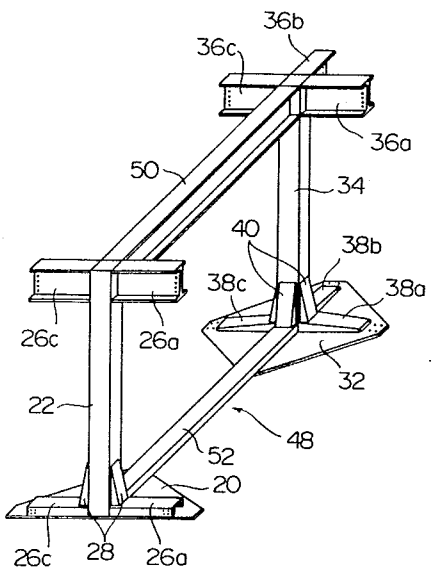
FIG. 9 is a perspective view showing a fifth embodiment of the assembly element in the assemblable structure shown in FIG. 1.

An assembly element 48 in the fifth embodiment shown in FIG. 9 is constructed by combining the assembly element 18 in the second embodiment shown in FIG. 6 and the assembly element 30 in the third embodiment shown in FIG. 7. Specifically, the upper end portions of the assembly elements 18 and 30 are connected to each other detachably via a beam member and their lower end portions are connected detachably via a brace member. In the assembly element 48 in the fifth embodiment, as in the case of the assembly element 42 in the fourth embodiment, these connecting members are fixed between the two assembly elements to form an integral unit. More specifically, the assembly element 48 has a base plate 20, a pillar 22 extending upwardly from the base plate 20, a base plate 32, and a pillar 34 extending upwardly from the base plate 32. One end of a beam member 50 is fixed to the upper end portion of the pillar 22, and the other end thereof, to the upper end portion of the pillar 34. Furthermore, one end of a brace member 52 is fixed to the lower end portion of the pillar 22, and its other end, to the lower end portion of the pillar 34. Correspondingly to the brace member 52, reinforcing materials 28 and 40 (two of the three reinforcing members 28 and three of the four reinforcing members 40 are shown in FIG. 9), like reinforcing materials 26*a*, 26*c*, 38*a*, 38*b* and 38*c*, are disposed. In other words, as can be easily understood from a comparison of FIGS. 6 and 7 with FIG. 9, the assembly element 48 in the fifth embodiment is constructed by connecting the assembly element 18 shown in FIG. 6 and the assembly element 30 shown in FIG. 7 to each other via the beam member 50 instead of providing the connecting portions 24*b* and 36*d* and also via the brace member 52 instead of providing the reinforcing materials 26*b* and 38*d*.

Figure 10:
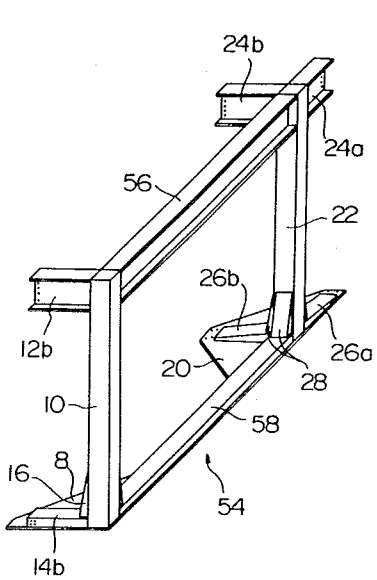
FIG. 10 is a perspective view showing a sixth embodiment of the assembly element in the assemblable structure shown in FIG. 1.

An assembly element 54 in the fifth embodiment shown in FIG. 10 is constructed by combining the assembly element 6 in the first embodiment shown in FIG. 5 and the assembly element 18 in the second embodiment shown in FIG. 6 nearly as in the assembly element 42 in the fourth embodiment shown in FIG. 8 As can be easily understood from a comparison of FIGS. 5 and 6 with FIG. 10 (and more easily from a comparison of FIG. 8 with FIG. 10), the assembly element 54 in the sixth embodiment is constructed by connecting the assembly element 6 shown in FIG. 5 and the assembly element 18 shown in FIG. 6 to each other via a beam member 56 instead of providing the connecting portions 12*a* and 24*c* and also via a brace member 58 instead of providing the reinforcing members 14*a* and 26*c*.

As required, an assembly element of a seventh embodiment (not shown) constructed by combining two assembly elements 30 in the third embodiment shown in FIG. 7 may also be used. The assembly element in the seventh embodiment can be constructed by connecting two assembly elements 30 shown in FIG. 7 to each other via a beam member instead of providing the connecting portion 36*a* (or 36*b*, 36*c*, or 36*d*) in one of them and the connecting portion 36*a* (or 36*b*, 36*c* or 36*d*) in the other and also via a brace member instead of providing the reinforcing material 38*a*, (or 38*b*, 38*c* or 38*d*) in one of the elements and the reinforcing material 38*a* (or 38*b*, 38*c* or 38*d*) in the other.

The beam members 44, 50 and 56 and the brace members 46, 52 and 58 may also be fixed in place by welding or otherwise. In the illustrated embodiments, the beam members 44, 50 and 56 are formed of a steel material having an H-shaped section (substantially the same as the various connecting portions), and the brace members 46, 52 and 58 may be formed of a steel material having a channel-shaped section.

When the assembly elements 42, 48 and 54 shown in FIGS. 8 to 10 are used instead of the assembly elements 6, 18 and 30 shown in FIGS. 5 to 7, the assembly element become large in size and some trouble occurs in transportation, for example. However, this brings about the advantage that these elements can be assembled and disassembled in the field within a short period of time.

The main body 2 of the structure can be built up by connecting the various assembly elements described hereinabove in such a way as to be able to be disassembled. With reference to FIGS. 2 to 4, the assembly elements are positioned in place as shown in FIGS. 2 to 4. When the land on which to place the main body 2 of the structure is soft, it must be graded so as to make it fully withstand the own weight of the main body 2 and loads to be exerted on it. As is known to those skilled in the art, the land should be graded by lime treatment and levelling pavement, for example, to prepare a substantially flat ground surface with the required strength.

Then, at one corner part of the main body 2, for example, the left top end in FIGS. 2 to 4, the assembly element 6 is connected to the adjoining assembly element 18, and in this manner, the elements are connected to each other successively to form a structure having the form shown in FIGS. 2 to 4. For example, the assembly elements 6 and 18, as are the other assembly elements, are disassembably connected to each other via a beam member 60 between their upper end portions and via a brace member 62 between their lower end portions. For example, in the assembly elements 6 and 18 positioned at the left top in FIGS. 2 to 4, the connecting portion 12*a* of the assembly element 6 is connected to one end portion of the beam member 60 via a connecting plate (not shown) (more specifically by connecting one end portion of the connecting plate to the connecting portion 12*a* of the assembly element 6 by means of a plurality of bolts and nuts and at the same time, connecting its other end portion to one end portion of the beam member 60 by means of a plurality of bolts and nuts). At the same time, the connecting portion 24*c* of the assembly element 18 is connected to the other end portion of the beam member 60 via connecting plate (not shown) (more specifically, by connecting one end portion of the connecting plate to the connecting portion 24*c* of the assembly element 18 by means of a plurality of bolts and nuts and its other end portion to the other end portion of the beam member 60 by a plurality of bolts and nuts). Furthermore, the reinforcing material 14*a* of the assembly element 6 is directly connected to one end portion of the brace member 62 by means of a plurality of bolts and nuts, and the reinforcing material 26*c* of the assembly element 18 is directly connected to the other end portion of the brace member 62 by means of a plurality of bolts and nuts. In the illustrated embodiments, all the beam members 60 in FIGS. 2 to 4 are connected disassembably to the corresponding assembly elements, and all the brace members 62 in FIGS. 2 and 3 are connected to the corresponding assembly elements in a disassembable manner. As can be understood from FIGS. 7 to 10, both end portions of each of the brace members 64 in FIGS. 2 and 3 are disassembably connected directly to the base plates of the corresponding assembly elements by means of bolts and nuts.

Thereafter, a plurality of upper plates 66 (partly shown by a two-dot chain in FIG. 4) of a suitable size are placed on the upper surface defined by the various assembly elements 6, 18, 30, 42, 48 and 54, and connected disassembably to these assembly elements by, for example, bolts and nuts.

As a result, the main body 2 of the structure shown in FIGS. 1 to 4 is assembled and placed on a prepared ground surface. The main body 2 of the structure, as can be understood from FIGS. 2 and 3, is in the shape of a relatively low-storied hollow box, and has a relatively large installation area and a large weight. Accordingly, it has a structural strength enough to overcome various conditions such as stress to bear external force by the fixed load by the own weight of the main body 2 of the structure and bearing power of the ground of the installation area (when the ground is soft, it is necessary to increase bearing power of the ground by improving the ground to obtain the required bearing power of the ground) and is equivalent to a conventional built structure permanently fixed to the ground even if it cannot be permanently fixed to the ground. The structure so assembled is used especially conveniently as a two-storied parking place utilizing the spaces effectively.

As shown in FIGS. 2 and 3, pillars 22 and 34 facing passage areas existing among parking areas (shown by broken lines in FIGS. 2 and 3) are positioned slightly rearwardly of the front ends of the parking areas. This structure permits easy incoming and outgoing of vehicles.

In the main body 2 of the structure shown above, vertical loads acting on the pillars 10, 22 and 30 of the assembly elements 6, 18, 30, 42, 48 and 54 are substantially borne by the base plates 8, 20 and 32. Accordingly, the structure needs not to be fixed to the ground as is the case with the prior art. This enables the main body 2 of the structure to be assembled and disassembled and re-utilized without scrapping.

In the illustrated embodiments, the main body 2 of the structure is assembled by using the assembly elements 6, 18 and 30 shown in FIGS. 5 to 7 at the upper portion in FIGS. 2 to 4, and the assembly elements 42, 48 and 54 shown in FIGS. 8 to 10 at the lower portion in FIGS. 2 to 4. This is not essential, and it may be assembled by suitably combining these assembly elements. For example, the whole main body 2 of structure may be assembled by using the assembly elements 6, 18 and 30 shown in FIGS. 5 to 7. Alternatively, the whole main body 2 may be assembled by using the assembly elements 42, 48 and 54 shown in FIGS. 8 to 10.

In the illustrated embodiments, the main body 2 of the structure is substantially rectangular when viewed from above. This is not limitative, and it may be constructed in various desired shapes corresponding to the shape of the land by suitably selecting the combinations of the assembly elements 6, 18 and 30.

As required, an auxiliary beam member may be detachably connected to opposing beam members 60 to increase strength.

In principle, the main body 2 of the structure is constructed by connecting the assembly elements 6, 18 and 30. But it may also be constructed by connecting a plurality of assembly elements 30 via the beam members 60 and brace members 64, although in this case, some of the connecting portions will project out of the structure.

Figure 11:
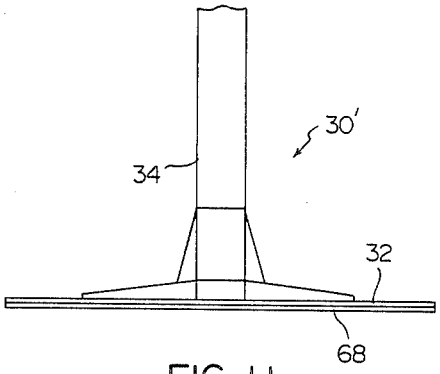
FIG. 11 is a front elevation showing part of a modified example of the assembly element of the third embodiment.

Preferably, a sheet-like member formed, for example, of a rubber material is attached to the lower surfaces (the ground-contacting surfaces) of the base plates 8, 20 and 32 in the assembly elements 6, 18, 30, 42, 48 and 54 described above. One example is shown in FIG. 11 which indicates a modified example of the assembly element 30 shown in FIG. 7. A sheet-like member 68 made, for example, from a synthetic rubber is fixed to the substantially entire area of the lower surface of the base plate 32 of an assembly element 30' by an adhesive, for example. This structure results in an increased friction between the base plate 32 and the ground surface, and can prevent slippage of the assembly element 30' and increase its stability. At the same time, this permits corosion inhibition of the base plate 32 of the assembly element 30'. Furthermore, in the event that a shock is applied to the main body 2 of the structure (for example, by earthquake), the sheet-like member can effectively absorb the shock.

Figure 12:
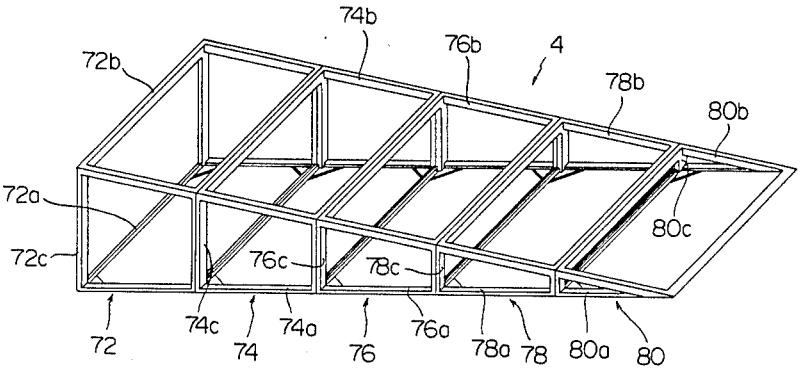
FIG. 12 is a perspective view showing the inclined passage assembly in the assemblable structure shown in FIG. 1.
Figure 13:
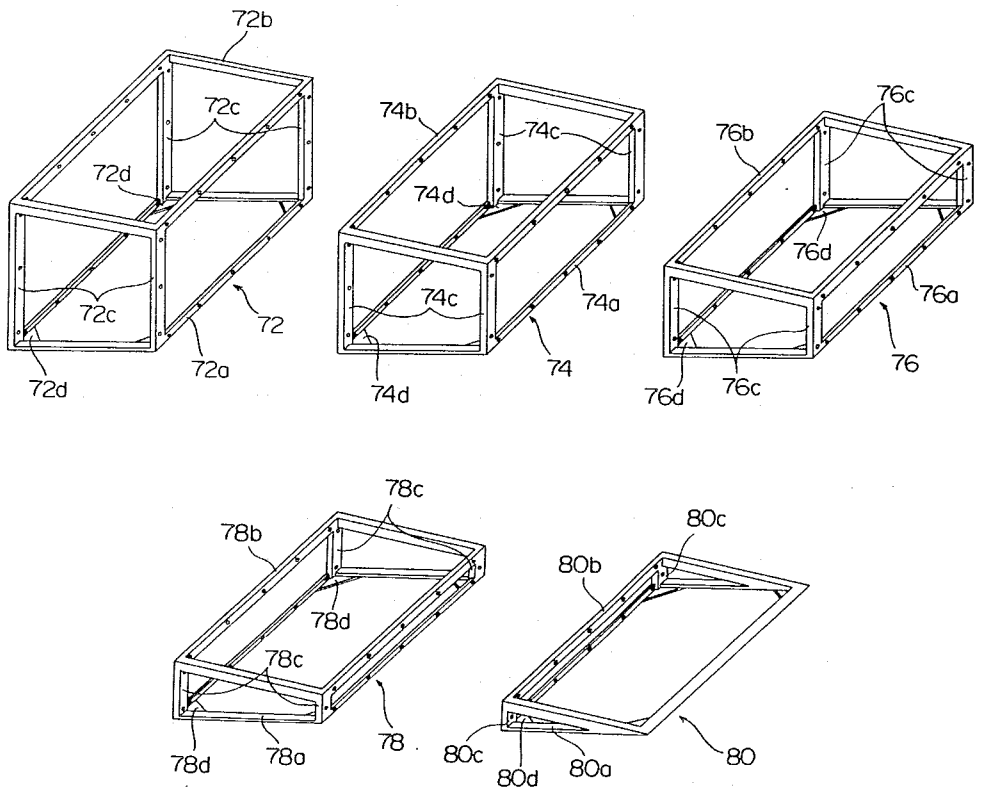
FIG. 13 is a perspective view showing the individual inclined passage assembly elements of the inclined passage assembly shown in FIG. 12.

Now, with reference to FIGS. 12 and 13 together with FIG. 1, an inclined passage assembly 4 will be described. The illustrated inclined passage assembly 4 includes five inclined passage assembly elements 72, 74, 76, 78 and 80 which are substantially of the same structure except having different heights. The structure of the inclined passage assembly element 72 (74, 76, 78, 80) will be described in detail with reference mainly to FIG. 13.

The inclined passage assembly elements 72 (74, 76, 78 and 80) have lower frame members 72*a* (74*a*, 76*a*, 78*a*, and 80*a*) defining a substantially flat under surface and upper frame members 72*b* (74*b*, 76*b*, 78*b*, and 80*b*) defining a substantially flat upper surface, respectively. The lower frame members 72*a* (74*a*, 76*a*, 78*a*, and 80*a*) in the illustrated embodiment are constructed by connecting four steel materials having a channel-shaped section in a rectangular form. The upper frame members 72*b* (74*b*, 76*b*, 78*b* and 80*b*) are constructed by connecting four steel materials having a channel-shaped section in a rectangular form. The lower frame members 72*a* (74*a*, 76*a* and 78*a*) are connected to the upper frame members 72*b* (74*b*, 76*b*, and 78*b*) via four connecting members 72*c* (74*c*, 76*c* and 78*c*). Specifically, the lower ends of the connecting members 72*c* (74*c*, 76*c* and 78*c*) are fixed to the four corner parts of the lower frame members 72*a* (74*a*, 76*a* and 78*a*), and the upper ends of the connecting members 72*c* (74*c*, 76*c* and 78*c*) are fixed to the four corner parts of the upper frame members 72*b* (74*b*, 76*b* and 78*b*). Two of the four connecting members 72*c* (74*c*, 76*c*, and 78*c*) are larger in length than the remaining two. Hence, the upper surfaces of the upper frame members 72*b* (74*b*, 76*b* and 78*b*) form an inclined surface. In the inclined passage assembly element 80, one end of the lower frame member 80*a* is connected to one end of the upper frame member 80*b* by two relatively short connecting members 80*c*, and their other ends are directly connected, as shown in FIG. 13. As a result, the upper surface of the upper frame member 80*b* defines an inclined surface.

Preferably, in the inclined passage assembly elements 72 (74, 76, 78 and 80), bottom plates 72*d* (74*d*, 76*d*, 78*d* and 80*d*) are provided for bearing the weights of the assembly elements themselves and loads acting thereon. In the illustrated embodiment, each of the bottom plates 72*d* (74*d*, 76*d*, 78*d*, and 80*d*) is formed of a steel sheet in the shape of a nearly right-angled triangle, and is fixed to the under surfaces of the four corner parts of each of the lower frame members 72*a* (74*a*, 76*a*, 78*a*, and 80*a*).

The various members of the inclined passage assembly elements 72 (74, 76, 78 and 80) can be fixed by welding or otherwise.

The inclined passage assembly 4 may be built up, for example, by disassemblably connecting the inclined passage assembly elements 72 (74, 76, 78, and 80) after assembling the main body 2 of the structure. Specifically, the inclined passage assembly elements are positioned in place as shown in FIGS. 1, 2 and 12, and then the adjoining inclined passage assembly elements are connected to each other. For example, the inclined passage assembly element 72 may be disassemblably connected to the inclined passage assembly element 74 by applying bolts and nuts to the adjoining parts of the two elements. Connection of the other inclined passage assembly elements can be achieved in the same way. When the assembly elements 72, 74, 76, 78 and 80 are connected properly, the inclined passage assembly 4 of the form shown in FIG. 2 is built up. Thereafter, an upper plate (not shown) that can be formed of a steel sheet, for example, is placed on the upper surfaces of the inclined passage assembly elements 72, 74, 76, 78 and 80 and connected thereto disassemblably by means of bolts and nuts. If desired, upper plates may be fixed in advance by welding or otherwise to the upper surfaces of the inclined passage assembly elements 72, 74, 76, 78 and 80. As a result, the inclined passage assembly 4 shown in FIG. 1 is placed on the prepared ground surface. In this inclined passage assembly 4, the upper plates (not shown) define a substantially continuous inclined surface and function to conduct a vehicle to the upper plates 66 of the main body 2 of the structure (and therefore, to an outdoor parking place).

In the illustrated embodiments, the inclined passage assembly is annexed, for example, between the pillar 22 of the assembly element 18 and the pillar 22 of the assembly element 54 at the right end portion (the right end portion in FIG. 2) of the main body 2 of the structure. Hence, in the illustrated structure, the portion between the pillar 22 of the assembly element 18 and the pillar 22 of the assembly element 42 in the left end portion of the main body 2 serves as an entrance and an exit for the first floor of the parking structure, and the inclined passage assembly 4 annexed to the right end portion of the main body 2 serves as an entrance and an exit for the second floor of the parking structure. The inclined passage assembly 4 may be set up at any desired site in relation to the shape, etc. of the main body 2 of the structure.

Preferably, the above structure is constructed as described below in order that it functions properly and conveniently as a parking place.

With the reference to FIG. 3, the brace members 62 and 64 connected to, and across, the lower end portions of the pillars of the assembly elements act as a reinforcement against shocks and impacts which may be generated in the event that a vehicle collides with the pillars. Since the brace members 64 are disposed at sites where vehicles pass, they preferably have a relatively small thickness so as not to hamper passing and parking of vehicles. On the other hand, since the brace members 62 are disposed at sites where vehicles do not pass or it is necessary to hamper passage of vehicles, they preferably have a relatively large thickness so as to hamper passing of vehicles. Particularly, in the brace members in the outside portion of the main body 2 of the structure, the above function is especially required to prevent overrunning of vehicles out of the structure.

Since the second floor is also utilized as a parking space, it is preferred for the sake of safety to provide a safety fence (not shown) for preventing falling of vehicles out of the structure in the peripheral portion of the structure excepting the entrance and exit. Such a safety fence may also be provided on both side portions on the upper surface of the inclined passage assembly 4.

While one embodiment of the place-on type assemblable structure constructed in accordance with this invention has been described with regard to its use as a parking place, it should be understood that the invention is not limited to this specific embodiment, and can also be applied to other uses such as a warehouse.

EXAMPLE

A place-on type assemblable structure of the form shown in FIGS. 1 to 4 was utilized as a parking station accommodating 18 vehicles. The required strength was obtained by using various elements having the following sizes. The following are average examples of application, and may slightly differ depending upon the texture, shape, etc. of the land.

Assembly elements of the first embodiment
Base plate: steel sheet, 19 mm thick
Area of the bottom of the base plate: 0.68 $m^2$
Pillar: Steel pillar having a size of 200 mm×200 mm
Thickness of each side wall of the pillar: 8 mm
Length of the pillar: 2.4 m
Assembly elements of the second embodiment
Base plate: steel sheet, 19 mm thick
Area of the bottom of the base plate: 1.16 $m^2$
Pillar: steel pillar having a size of 200 mm×200 mm
Thickness of each side wall of the pillar: 8 mm
Length of the pillar: 2.4 m
Assembly elements of the third embodiment
Base plate: steel sheet, 19 mm thick
Area of the bottom of the base plate: 1.96 $m^2$
Pillar: steel pillar having a size of 200 mm×200 mm
Thickness of each side wall of the pillar: 12 mm
Length of the pillar: 2.4 m
Other elements
Brace members that permit passage of vehicles: steel sheet having a thickness of 19 mm and a width of 150 mm
Brace members hampering passage of vehicles: steel material having a width of 180 mm, a height of 75 mm and a thickness of 7 mm
Beam members: steel material having a height of 290 mm and a width of 200 mm

What is claimed is:

1. A three dimensional place-on type assemblable vehicle parking structure adapted to be placed on a substantially flat surface, said structure including the following:

a. a plurality of assembly elements, each said assembly element having a base plate which has a lower ground-contacting surface which is lying on said flat surface, each said assembly element also including a pillar extending upwardly from the base plate wherein a vertical load acting on the pillar is substantially borne by the base plate, each said pillar having an upper end and a lower end;

b. beam members connecting the upper ends of the pillars of adjoining assembly elements; and, c. brace members connecting the lower ends of the pillars of adjoining assembly elements;

said structure providing a plurality of three dimensional parking spaces which are capable of receiving parked vehicles.

2. The structure of claim 1 wherein a reinforcing material is provided in a connecting portion between the base plate and the pillar.

3. The structure of claim 1 wherein a sheet-like member formed of a rubbery material is provided on the bottom surface of the base plate which makes contact with the substantially flat surface.

4. The structure of claim 1 wherein the pillar extends substantially vertically from the base plate.

5. The structure of claim 1 wherein two connecting portions are provided in the upper end portion of the pillar, and the two connecting portions extend in a lateral direction substantially perpendicular to the axial direction of the pillar and are spaced from each other substantially by an angle of 90 degrees.

6. The structure of claim 1 wherein three connecting portions are provided in the upper end portion of the pillar, and the three connecting portions extend in a lateral direction substantially perpendicular to the axial direction of the pillar and are spaced from each other substantially by an angle of 90 degrees.

7. The structure of claim 1 wherein four connecting portions are provided in the upper end portion of the pillar, and the four connecting portions extend in a lateral direction substantially perpendicular to the axial direction of the pillar and are spaced from each other substantially by an angle of 90 degrees.

8. The structure of claim 1 wherein one connecting portion is provided in the upper end portion of one of the pillars and two connecting portions are provided in the upper end portion of the other pillar, the connecting portion provided in said one pillar extends in a lateral direction substantially perpendicular to the axial direction of the pillar and is spaced from the beam member substantially by an angle of 90 degrees in a predetermined direction, and the two connecting portions provided in the other pillar extend in a lateral direction substantially perpendicular to the axial direction of the other pillar and are spaced from the beam member substantially by an angle of 90 and 180 degrees in a direction opposite to said predetermined direction.

9. The structure of claim 1 wherein two connecting portions are provided in the upper end portion of said one pillar and three connecting portions are provided in the upper end portion of the other pillar, the two connecting portions provided in said one pillar extend in a lateral direction substantially perpendicular to the axial direction of said pillar and are spaced from the beam member substantially by an angle of 90 degrees in a predetermined direction and in a direction opposite to said predetermined direction, and the three connecting portions provided in the other pillar extend in a lateral direction substantially perpendicular to the axial direction of the pillar and are spaced from the beam member substantially by an angle of 90, 180 and 270 degrees in a direction opposite to said predetermined direction.

10. The structure of claim 1 wherein three connecting portions are provided in the upper end portion of each of the pillars, the three connecting portions provided in one pillar extend in a lateral direction substantially perpendicular to the axial direction of said one pillar and are spaced from the beam member substantially by an angle of 90, 180 and 270 degrees in a predetermined direction, and the there connecting portions provided in the other pillar extend in a lateral direction substantially perpendicular to the axial direction of the pillar and are spaced from the beam member substantially by an angle of 90, 180 and 270 degrees in a direction opposite to said predetermined direction.

11. The structure of claim 1 which further comprises an inclined passage assembly annexed thereto for using said structure as a parking place, said inclined passage assembly; being assemblable and adapted to be placed on a substantially flat surface.

12. The structure of claim 11 wherein the inclined passage assembly comprises a plurality of inclined passage assembly elements, and each of the assembly elements has a bottom plate for substantially bearing a vertical load acting thereon.

13. The structure of claim 12 wherein each of said inclined passage assembly elements includes a lower frame member defining a substantially flat lower surface and an upper frame member defining a substantially flat inclined upper surface, and the bottom plate is provided in the lower frame member.

* * * * *